US006701578B1

(12) United States Patent
Lu

(10) Patent No.: US 6,701,578 B1
(45) Date of Patent: Mar. 9, 2004

(54) TELESCOPIC HANDLE FOR A CLEANING IMPLEMENT

(76) Inventor: Jung-Hui Lu, No. 2, Chao-Ming Rd., Nantze Dist., Kaohsiung (TW)

( * ) Notice: Subject to any disclaimer, the term of this patent is extended or adjusted under 35 U.S.C. 154(b) by 0 days.

(21) Appl. No.: 10/316,905

(22) Filed: Dec. 12, 2002

(51) Int. Cl.[7] ..... B25G 1/04

(52) U.S. Cl. ..... 16/429; 16/DIG. 41; 16/436; 15/144.4

(58) Field of Search ..... 16/429, 113.1, 16/436, DIG. 41; 15/144.1–144.4, 235.8, 236.3; 81/177.1, 177.2, 489; 403/107, 109.1, 109.4, 377; 294/19.1, 19.2, 19.3, 57

(56) References Cited

U.S. PATENT DOCUMENTS

| | | | | | |
|---|---|---|---|---|---|
| 2,841,425 | A | * | 7/1958 | Oeters | 403/104 |
| 2,902,592 | A | * | 9/1959 | Cole et al. | 362/277 |
| 3,380,097 | A | * | 4/1968 | Pharris | 15/145 |
| 3,489,451 | A | * | 1/1970 | Guckenberger | 294/19.1 |
| 4,524,484 | A | * | 6/1985 | Graham | 16/429 |
| 4,659,125 | A | * | 4/1987 | Chuan | 294/19.2 |
| 4,856,929 | A | * | 8/1989 | Smahlik et al. | 403/297 |
| 4,967,484 | A | * | 11/1990 | Nosek | 33/781 |
| 5,011,319 | A | * | 4/1991 | Levi et al. | 403/109.5 |
| 5,692,856 | A | * | 12/1997 | Newman et al. | 403/352 |
| 5,887,314 | A | * | 3/1999 | Jordan, Jr. | 15/144.3 |
| 5,940,933 | A | * | 8/1999 | Chang | 15/144.4 |
| 6,182,539 | B1 | * | 2/2001 | Webster | 81/177.2 |

FOREIGN PATENT DOCUMENTS

| | | | | | |
|---|---|---|---|---|---|
| AU | 9228595 | A | * | 5/1993 | A47L/13/10 |
| DE | 2448877 | A | * | 4/1976 | B25G/1/04 |
| DE | 3123160 | A | * | 1/1983 | B23B/45/00 |
| GB | 2272632 | A | * | 5/1994 | A46B/17/04 |

* cited by examiner

*Primary Examiner*—Chuck Y. Mah
(74) *Attorney, Agent, or Firm*—Bacon & Thomas, PLLC

(57) ABSTRACT

A telescopic handle for a cleaning implement has a seat, an outer tube mounted in the seat, an inner tube received in the outer tube, and a middle tube movably provided between the outer tube and the inner tube. A sealing member is secured inside a rear end of the middle tube and movably provided outside the inner tube. A positioning sleeve is mounted at a front end of the outer tube. The handle has a good watertight effect, and can be used over a long-term.

10 Claims, 4 Drawing Sheets

TELESCOPIC HANDLE FOR A CLEANING IMPLEMENT

BACKGROUND OF THE INVENTION

1. Field of the Invention

The present invention is related to a cleaning implement, and more particularly to a telescopic handle for the cleaning implement.

2. Description of Related Art

Referring to FIG. 6, a conventional telescopic handle for a cleaning implement has an outer tube (41) and an inner tube (42) movably provided in the outer tube (41). A rear end of the outer tube (41) is mounted in a seat (43), and a sealing member (44) is secured at a rear end of the inner tube (42). A positioning sleeve (45) including an inner sleeve (451) and an outer sleeve (452) is mounted at a front end of the outer tube (41). A joint (46) is mounted at a front end of the inner tube (42) for attaching a brush (not shown or numbered).

The inner tube (42) can be extended out from the outer tube (41) to lengthen an overall length of the handle, and positioned by screwing the outer sleeve (452) of the positioning sleeve (45). Water or cleanser can flow through the inner tube (42) and out of from the joint (46).

However, a caliber of the inner tube (42) is slightly smaller than a caliber of the outer tube (41), so that the weight of the handle when full of water or cleanser is great, which is very difficult and inconvenient to use.

Referring to FIG. 7, another conventional handle has an outer tube (51) and an inner tube (53) received in the outer tube (51). The outer tube (51) and the inner tube (53) are mounted on a seat (54). A middle tube (52) is movably provided between the outer tube (51) and the inner tube (53); A cap (55) is provided at a rear end of the middle tube (52), and a sealing member (58) including two sealing rings (581) is provided at a front end of the inner tube (53). The sealing rings (581) are tightly abutted an inner wall of the middle tube (52). A positioning sleeve (56) including an inner sleeve (561) and a taper outer sleeve (562) is provided at a front end of the outer tube (51). A joint (57) is mounted at a front end of the middle tube (52).

Because the middle tube (52) is provided, a caliber of the inner tube (53) can be significantly smaller than that of the outer tube (51) to reduce the weight of the handle when full of water or cleanser. However, because the sealing rings (581) have a round cross section which must be deformed to tightly abut the inner wall of the middle tube (52) for achieving a watertight effect, a friction between the sealing rings (581) and the middle tube (52) is large, which makes it difficult for a user to extend or retract the middle tube (52). Furthermore, the sealing ring (581) is generally made of rubber, and the outer tube (51) and the middle tube (52) are generally made of aluminum harder than rubber. Thus, the sealing ring (581) will be worn out after using the cleaner only a very short time.

Therefore, the invention provides a telescopic handle for a cleaning implement to mitigate and/or obviate the aforementioned problems.

SUMMARY OF THE INVENTION

The main objective of the invention is to provide a telescopic handle for a cleaning implement which is easy to operate.

Another objective of the invention is to provide a telescopic handle for a cleaning implement which has a good watertight effect.

A further objective of the invention is to provide a telescopic handle for a cleaning implement which is durable.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
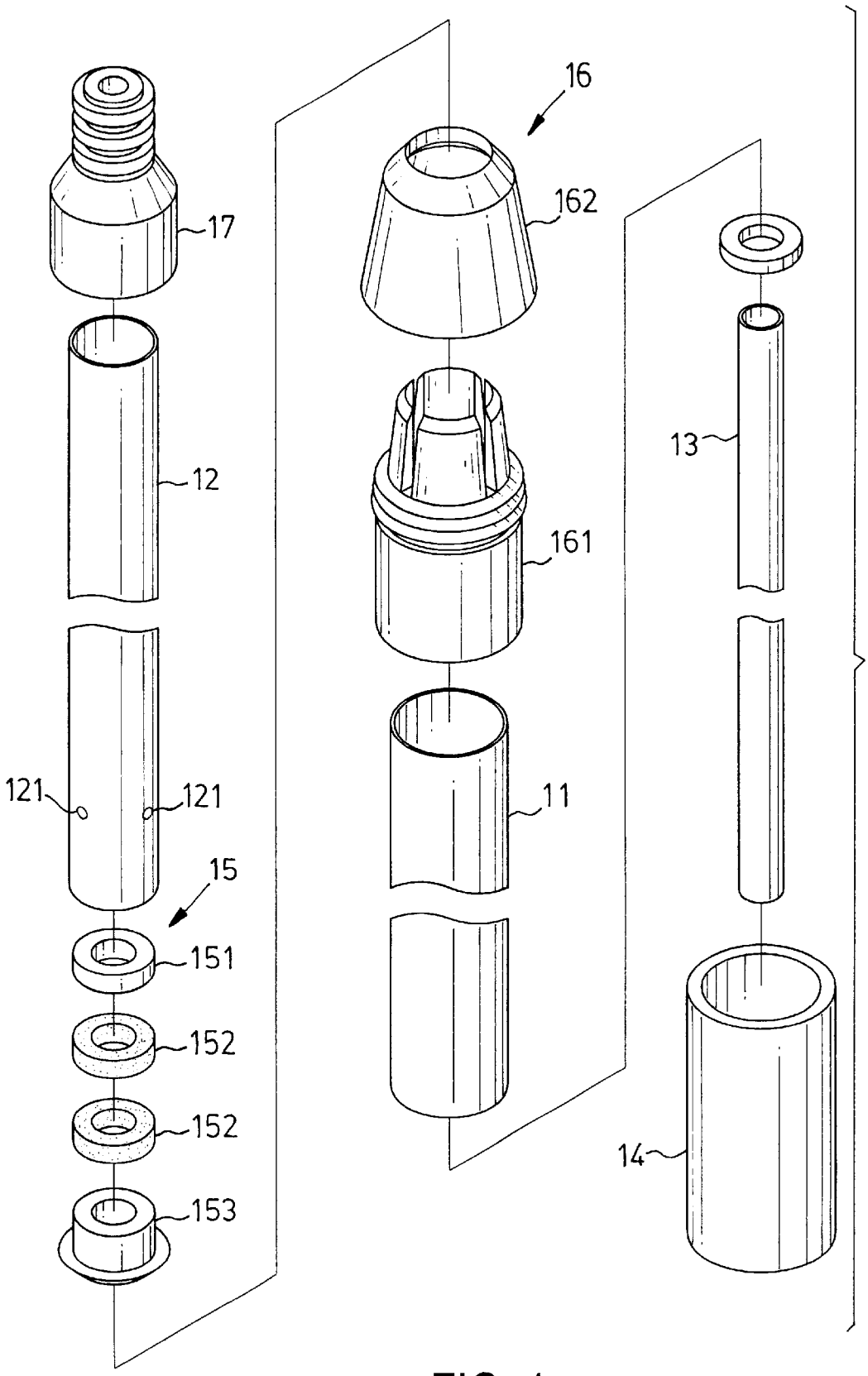
FIG. 1 is an exploded perspective view of a telescopic handle for a cleaning implement in accordance with the invention.
Figure 3:
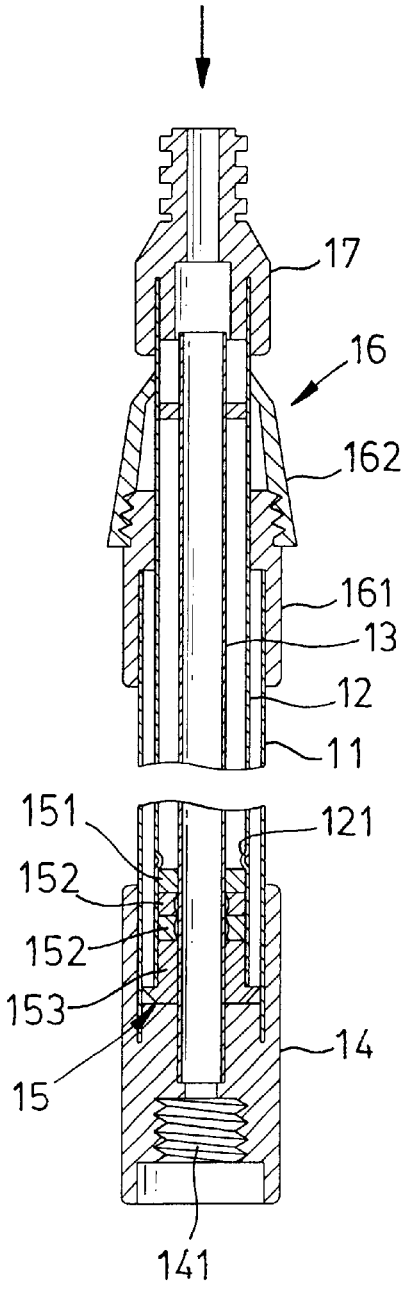
FIG. 3 is a sectional view of the telescopic handle in FIG. 1 in a retracted status.
Figure 2:
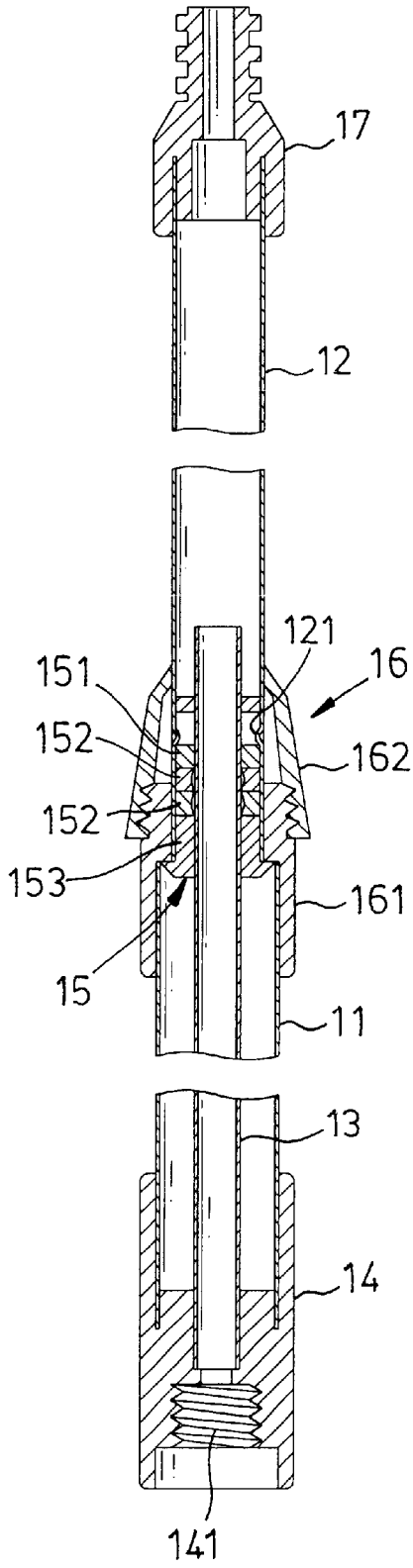
FIG. 2 is a sectional view of the telescopic handle in FIG. 1 in an extended status.

Referring to FIGS. 1–3, a telescopic handle for a cleaning implement has an outer tube (11) mounted in a seat (14). The seat (14) has an inlet (141) defined therein for connecting with a flow pipe (not shown or numbered). An inner tube (13) is mounted in the seat (14) and communicated with the inlet (141) and received in the outer tuber (11). A middle tube (12) is movably received between the outer tube (11) and the inner tube (13). The inner tube (13) is made of a plastic material.

A sealing member (15) is provided inside a rear end of the middle tube (12) and outside the inner tube (13), and a joint (17) is provided at a front end of the middle tube (12) extending over the outer tube (I 1)and the inner tube (13). By the joint (17), a brush (not shown or numbered) can be mounted on the handle.

A positioning sleeve (16) is provided outside a front end of the outer tube (11), and the middle tube (12) and the inner tube (13) extend through the positioning sleeve (16).

The sealing member (15) includes a fastening ring (151), two sealing rings (152) and a cap (153) in turn received in the middle tube (12) and provided outside the inner tube (13). The middle tube (12) further has a plurality of lugs (121) formed at an inner wall thereof to position the fastening ring (151), and the cap (153) is securely mounted in the rear end of the middle (12) by means of punching. The sealing rings (152) each have an opening (not numbered) with an arcuate inner wall, wherein a diameter of two end portions of the opening is larger than a diameter of the central portion of the opening. Therefore, the end portions of the sealing rings (152) can tightly abut an outer periphery of the inner tube (13) to provide a good watertight effect.

The positioning sleeve (16) has an inner sleeve (161) mounted on the front end of the outer tube (11) and a tapered outer sleeve (162) threadingly provided outside the inner sleeve (161). The inner sleeve (161) has a plurality of tapered claws (not numbered). When the outer sleeve (162) is screwed, the tapered claws are pressed against the middle tube (12), so the middle tube (12) can be positioned.

In use, water or cleanser flows through the inlet (141), the inner tube (13), the middle tube (12) and out of from the joint (17). The handle is sealed by the sealing member (15), so the water or cleanser will not leak out. The middle tube (12) can be extended by means of loosening the positioning sleeve (16), and be positioned at the desired length by screwing the outer sleeve (162) again.

Figure 4:
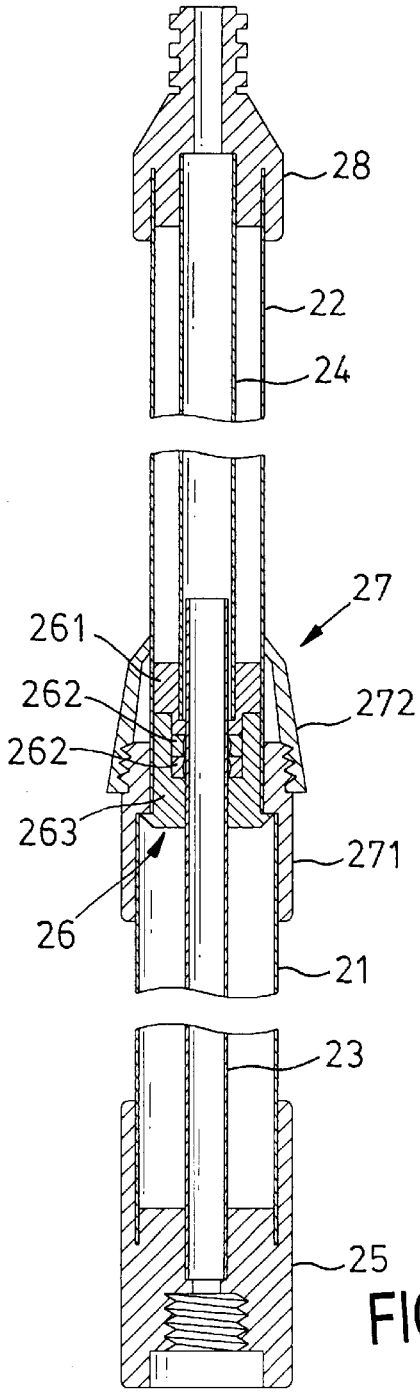
FIG. 4 is a sectional view of a second embodiment of the telescopic handle.
Figure 7:
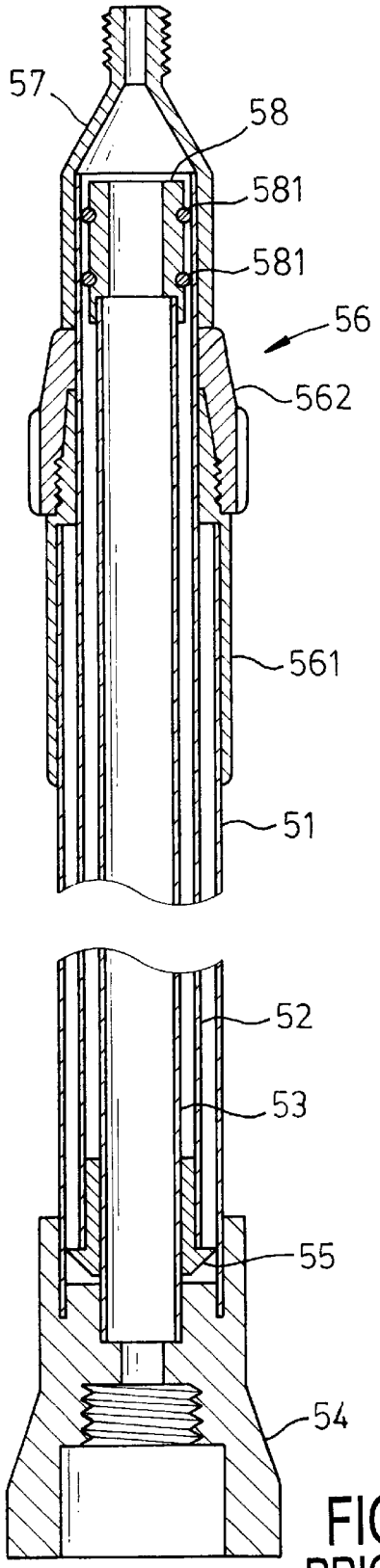
FIG. 7 PRIOR ART
FIG. 7 is a sectional view of another conventional handle.
Figure 6:
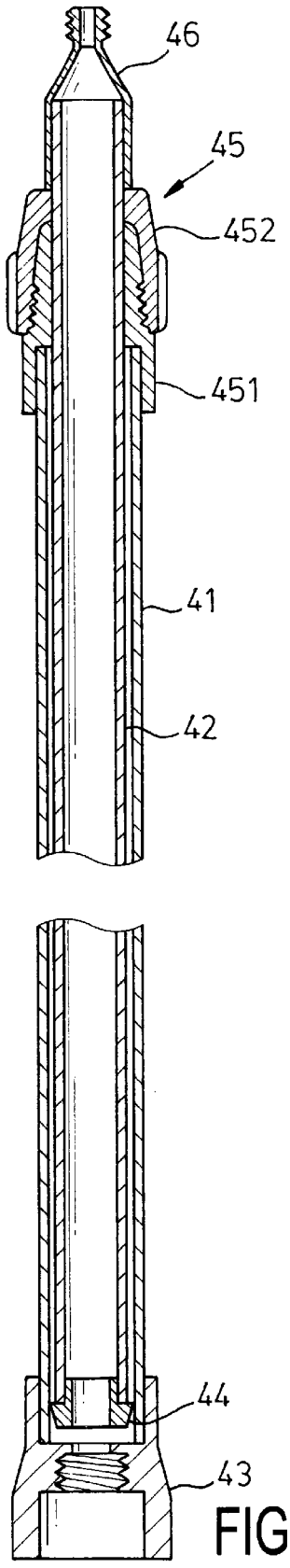
FIG. 6 PRIOR ART
FIG. 6 is a sectional view of a conventional handle.

Referring to FIG. 4, in a second embodiment according to the present invention, the handle has an outer tube (21) and an inner tube (23) secured in a seat (25). A first middle tube (22) is movably provided between the outer tube (21) and the inner tube (23).

A sealing member (26) is securely mounted at a rear end of the middle tube (22). A cap (263) with a chamber (not numbered) is secured on the rear end of the first middle tube (22), and two sealing rings (262) are received in the chamber of the cap (263). A fastening ring (261) has a flange (not numbered) inserted in the chamber of the cap (263) to fasten the sealing rings (262) in the chamber. The fastening ring (261) and the cap (263) are adhered together and secured in the first middle tube (22) by means of punching.

A second middle tube (24) is movably provided between the first middle tube (22) and the inner tube (23), and has a rear end mounted in the fastening ring (261). The inner tube (23) and second middle tube (24) are made of a plastic material. The second middle tube (24) can be extended or retracted along with the first middle tube (22).

A positioning sleeve (27) including an inner sleeve (271) and a tapered outer sleeve (272) is provided outside the outer tube (21), and a joint (28) is provided at front ends of the first middle tube (23) and the second middle tube (24).

Figure 5:
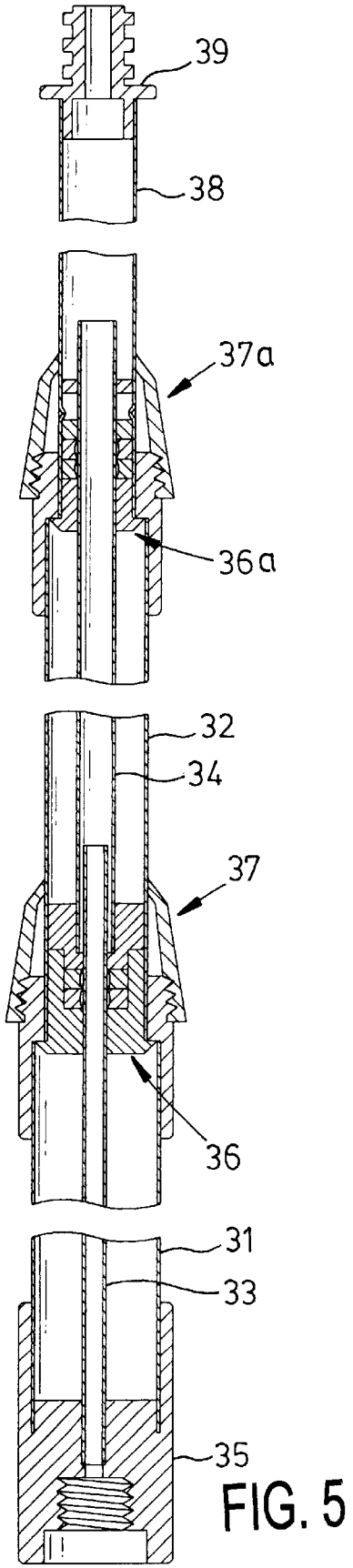
FIG. 5 is a sectional view of a third embodiment of the telescopic handle.

Referring to FIG. 5, in a third embodiment of the invention, the handle has an outer tube (31) and an inner tube (33) secured in a seat (35). A first middle tube (32) is movably provided between the outer tube (31) and the inner tube (33). A first sealing member (36) is securely mounted at a rear end of the middle tube (32). A second middle tube (34) is movably provided between the first middle tube (32) and the inner tube (33), and has a rear end mounted in the first sealing member (36). A first positioning sleeve (37) is provided outside the outer tube (31).

The handle further has a third middle tube (38) movably provided between the first middle tube (32) and the second middle tube (34). The inner tube (33) and the second middle tube (34) are made of a plastic material.

A second sealing member (36*a*) is securely mounted at a rear end of the third middle tube (38), and a second positioning sleeve (37*a*) is provided outside the first middle tube (32). A joint (39) is provided a front end of the third middle tube (38). Therefore, the first and second middle tubes (32, 34) can be extended from the outer tube (31), and the third middle tube (38) can be extended from the first and second middle tubes (32, 34).

From the above description, it is noted that the invention has the following advantages:

1. The handle has an inner tube with a caliber significantly smaller than a caliber of the outer tube, so that an overall flux of water or cleanser in the handle is small to make the handle light in use.

2. Because the opening of the sealing ring has an arcuate wall with two end portions tightly abutting the outer periphery of the inner tube, the sealing member has a good watertight effect.

3. Only the two end portions of the sealing ring tightly abut the inner tube, so the friction between the sealing rings and the inner tube is small, and it is easy to extend or retract the middle tube.

4. The inner tube and the second middle tube are made of plastic material with hardness as much as the sealing rings, so that the sealing ring can be used over a long time.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A telescopic handle for a cleaning implement, the handle comprising:

a seat (14) with an inlet (141);

an outer tube (11) mounted in the seat (14);

an inner tube (13) mounted in the seat (14) and received in the outer tube (11) and in communication with the inlet (141);

a first middle tube (12) movably provided between the outer tube (11) and the inner tube (13);

a sealing member (15) secured inside a rear end of the first middle tube (12) and movably provided outside the inner tube (13); and a positioning sleeve (16) mounted at a front end of the outer tube (11), the positioning sleeve (16) having an inner sleeve (161) secured on the front end of the outer tube (11), a plurality of tapered claws formed at a front end of the inner sleeve (161), and a tapered outer sleeve (162) threadingly mounted outside the inner sleeve (161), and the first middle tube (12) extending through the inner sleeve (161).

2. The handle as claimed in claim 1 further comprising a joint (17) provided at a front end of the first middle tube (12).

3. The handle as claimed in claim 1, wherein the sealing member (15) has a cap (151) secured at the rear end of first the middle tube (12), a fastening ring (153) positioned in the first middle tube (12) and two sealing rings (152) received between the cap (151) and the fastening ring (153).

4. The handle as claimed in claim 3, wherein the first middle tube (12) has a plurality of lugs (121) formed at an inner wall thereof to position the fastening ring (153).

5. The handle as claimed in claim 3, wherein the sealing rings (152) each have an opening with an arcuate inner wall, wherein a diameter of two end portions of the opening is larger than a diameter of the central portion of the opening.

6. The handle as claimed in claim 1, wherein the sealing member (26) has a cap (263) with a chamber secured at the rear end of the first middle tube (22), a fastening ring (261) attached to the cap (263) and having a flange inserted in the chamber of the cap (263), and two sealing rings (262) received in the chamber and between the cap (263) and the fastening ring (261).

7. The handle as claimed in claim 6 further comprising a second middle tube (24) provided between the inner tube (23) and the first middle tube (22), and secured in the fastening ring (261).

8. The handle as claimed in claim 7 further comprising a joint (28) mounted on front ends of the first and second middle tubes (22, 24).

9. The handle as claimed in claim 7 further comprising a third middle tube (38) provided between the first middle tube (32) and the second middle tube (34), a second sealing member (36*a*) secured inside a rear end of the third middle tube (38) and movably provided outside the second middle tube (34), and a second positioning sleeve (37*a*) mounted at a front end of the first middle tube (32) and the third middle tube (38) extending through the second positioning sleeve (37*a*).

10. The handle as claimed in claim 9 further comprising a joint (39) mounted on a front end of the third middle tube (38).

* * * * *